US009256160B2

(12) United States Patent
Konishi et al.

(10) Patent No.: US 9,256,160 B2
(45) Date of Patent: Feb. 9, 2016

(54) DEVELOPER STORAGE CONTAINER HAVING ROTARY CYLINDER PORTION INSIDE A MAIN BODY AND IMAGE FORMING APPARATUS PROVIDED WITH SAME

(71) Applicant: KYOCERA Document Solutions Inc., Osaka-shi, Osaka (JP)

(72) Inventors: Hirohito Konishi, Osaka (JP); Daisuke Eto, Osaka (JP); Arata Nakamura, Osaka (JP)

(73) Assignee: KYOCERA Document Solutions Inc. (JP)

( * ) Notice: Subject to any disclaimer, the term of this patent is extended or adjusted under 35 U.S.C. 154(b) by 0 days.

(21) Appl. No.: 14/600,247

(22) Filed: Jan. 20, 2015

(65) Prior Publication Data

US 2015/0205225 A1 Jul. 23, 2015

(30) Foreign Application Priority Data

Jan. 23, 2014 (JP) ..... 2014-010535

(51) Int. Cl.
*G03G 15/08* (2006.01)

(52) U.S. Cl.
CPC .... *G03G 15/0868* (2013.01); *G03G 2215/0802* (2013.01)

(58) Field of Classification Search
CPC ..... G03G 15/0834; G03G 15/0836; G03G 15/0837; G03G 15/0839; G03G 15/0832; G03G 15/0872; G03G 15/087; G03G 15/0868; G03G 15/0867; G03G 15/0896
USPC ..... 399/262, 263
See application file for complete search history.

(56) References Cited

U.S. PATENT DOCUMENTS

| | | | | |
|---|---|---|---|---|
| 5,432,592 | A * | 7/1995 | Watanabe et al. | 399/120 |
| 2008/0175629 | A1 * | 7/2008 | Eto et al. | 399/262 |
| 2008/0239868 | A1 * | 10/2008 | Takagi | 366/305 |
| 2009/0067888 | A1 * | 3/2009 | Murata et al. | 399/263 |
| 2010/0272465 | A1 * | 10/2010 | Yamazaki | 399/106 |
| 2010/0310278 | A1 * | 12/2010 | Naoi et al. | 399/263 |

FOREIGN PATENT DOCUMENTS

| | | | | |
|---|---|---|---|---|
| EP | 740219 | A2 * | 10/1996 | G03G 15/08 |
| EP | 0 744 670 | | 11/1996 | |
| JP | 8-314250 | | 11/1996 | |
| JP | 2002-6598 | | 1/2002 | |

* cited by examiner

*Primary Examiner* — Billy Lactaoen
*Assistant Examiner* — Arlene Heredia Ocasio
(74) *Attorney, Agent, or Firm* — Gerald E. Hespos; Michael J. Porco; Matthew T. Hespos

(57) ABSTRACT

A developer storage container includes a main body portion and a rotary cylindrical body. The main body portion has a cylindrical inner peripheral surface and a pair of main body side end surfaces. The rotary cylindrical body has a side surface having a cylindrical shape, a pair of rotary body end surfaces and a storage space configured to store developer. A slit extending is formed on the side surface of the rotary cylindrical body to allow communication between the internal space and the storage space. The rotary cylindrical body is so arranged in the internal space that a predetermined clearance is defined between the side surface and the inner peripheral surface of the main body portion. A developer discharge port is opened on the main body portion.

9 Claims, 10 Drawing Sheets

DEVELOPER STORAGE CONTAINER HAVING ROTARY CYLINDER PORTION INSIDE A MAIN BODY AND IMAGE FORMING APPARATUS PROVIDED WITH SAME

This application is based on Japanese Patent Application No. 2014-010535 filed with the Japan Patent Office on Jan. 23, 2014, the contents of which are hereby incorporated by reference.

BACKGROUND

The present disclosure relates to a developer storage container for storing developer and an image forming apparatus provided with the same.

Conventionally, the following toner cartridge is known as a developer storage container for storing developer inside. The toner cartridge includes a toner discharge port and a rotary stirring rod. The stirring rod includes a rotary shaft and a rod-like projection projecting from the rotary shaft. By the rotation of the stirring rod, toner in the toner cartridge is stirred and discharged from the toner discharge port.

Further, some toner cartridges are known to include a stirring paddle. The stirring paddle includes a rotary shaft and a plurality of stirring wings. The stirring wing is a plate-like member extending from the rotary shaft and a plurality of stirring wings are arranged in an axial direction.

SUMMARY

A developer storage container according to one aspect of the present disclosure includes a main body portion and a rotary cylindrical body. The main body portion has a cylindrical inner peripheral surface and a pair of main body side end surfaces arranged at opposite ends of the inner peripheral surface. An internal space of the main body portion is defined by the inner peripheral surface and the pair of main body side end surfaces. The rotary cylindrical body has a side surface having a cylindrical shape, a pair of rotary body end surfaces arranged at opposite ends of the side surface, a pair of rotary shafts arranged on the rotary body end surfaces and a storage space defined by an inner surface of the side surface and the pair of rotary body end surfaces and configured to store developer. A slit extending in a circumferential direction is formed on the side surface of the rotary cylindrical body to allow communication between the internal space and the storage space. The rotary cylindrical body is so arranged in the internal space that a predetermined clearance is defined between the side surface and the inner peripheral surface of the main body portion, and rotatably supported on the pair of main body side end surfaces with the rotary shafts. A developer discharge port which communicates with the internal space and from which the developer is discharged is opened on the main body portion.

An image forming apparatus according to another aspect of the present disclosure includes the above developer storage container, an image carrier, a developing device and a transfer unit. An electrostatic latent image is to be formed on a surface of the image carrier, and the image carrier carries a developer image. The developing device has the developer supplied from the developer storage container and supplies the developer to the image carrier. The transfer unit transfers the developer image from the image carrier to a sheet.

DETAILED DESCRIPTION

Figure 1:
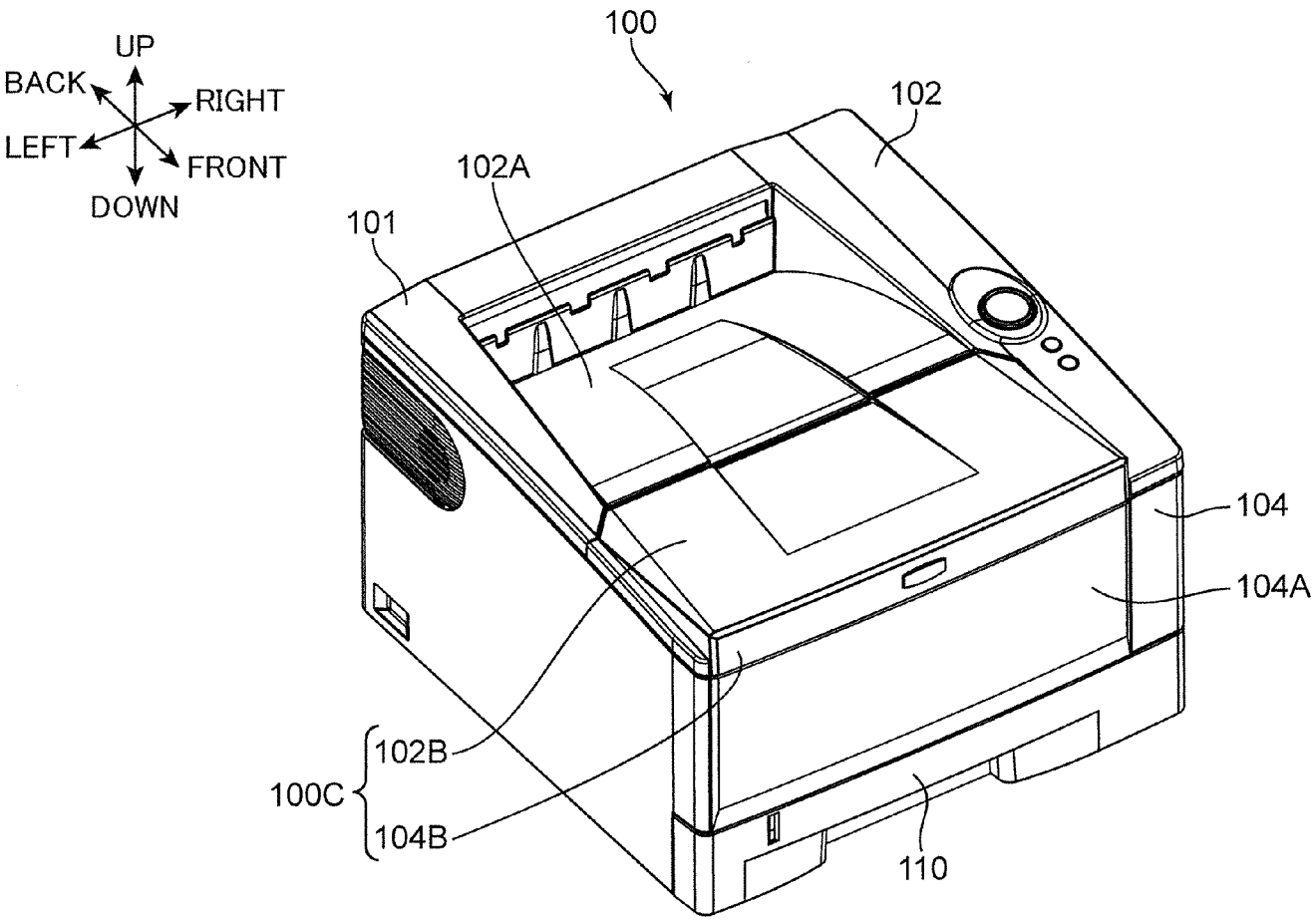
FIG. 1 is a perspective view showing an image forming apparatus according to one embodiment of the present disclosure.
Figure 2:
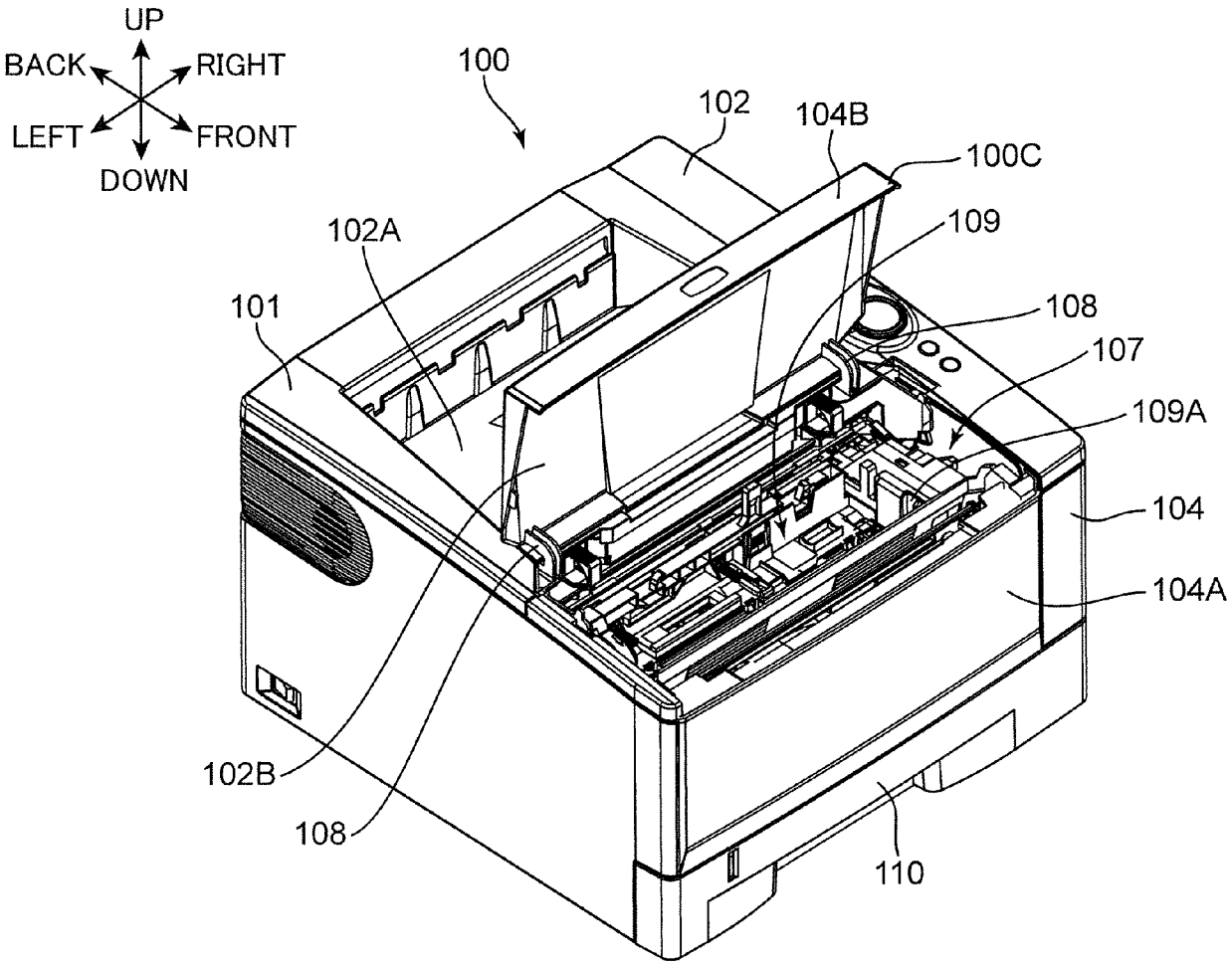
FIG. 2 is a perspective view showing a state where a part of the image forming apparatus according to the one embodiment of the present disclosure is exposed.
Figure 3:
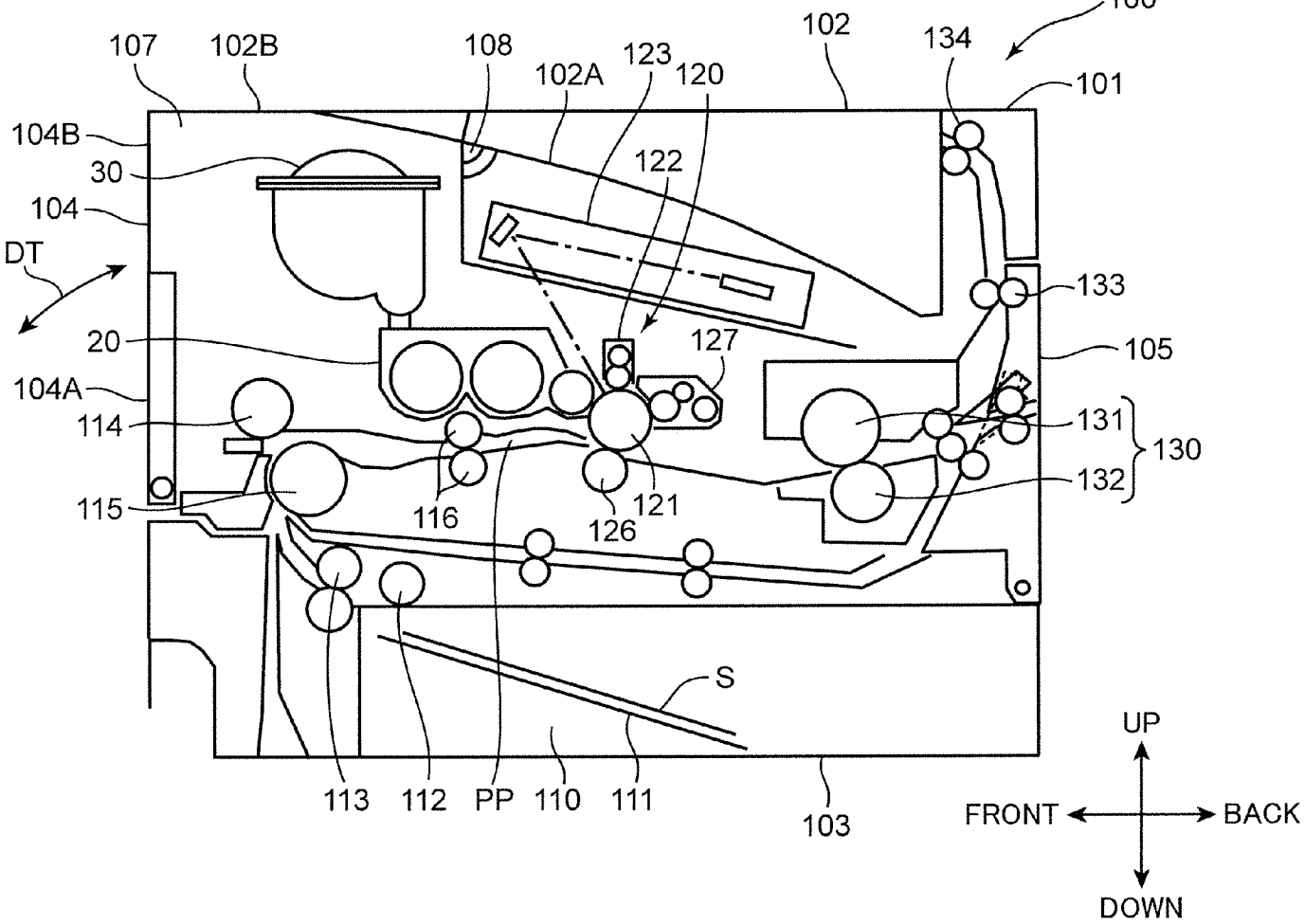
FIG. 3 is a schematic sectional view showing the internal structure of the image forming apparatus according to the one embodiment of the present disclosure.

Hereinafter, one embodiment of the present disclosure is described with reference to the drawings. FIGS. 1 and 2 are perspective views of a printer 100 (image forming apparatus) according to one embodiment of the present disclosure. FIG. 3 is a sectional view schematically showing the internal structure of the printer 100 shown in FIGS. 1 and 2. The printer 100 as an image forming apparatus shown in FIGS. 1 to 3 is a so-called monochrome printer, but the image forming apparatus may be a color printer, a facsimile machine, a complex machine provided with these functions or another apparatus for forming a toner image on a sheet in another embodiment. Note that direction-indicating terms such as "upper" and "lower", "front and "rear", "left" and "right" used in the following description are merely for the purpose of clarifying the description and do not limit the principle of the image forming apparatus at all.

The printer 100 is provided with a housing 101 for housing various devices for forming an image on a sheet S. The housing 101 includes an upper wall 102 defining the upper surface of the housing 101, a bottom wall 103 (FIG. 3) defining the bottom surface of the housing 101, a main body rear wall 105 (FIG. 3) between the upper wall 102 and the bottom wall 103 and a main body front wall 104 located in front of the main body rear wall 105. The housing 101 has a main body internal space 107 in which various devices are arranged. A sheet conveyance path PP in which a sheet S is conveyed in a conveying direction extends in the main body internal space 107 of the housing 101. Further, the printer 100 includes an opening/closing cover 100C openably and closably mounted with respect to the housing 101.

The opening/closing cover 100C is composed of a front wall upper part 104B which is an upper part of the main body front wall 104 and an upper wall front part 102B which is a front part of the upper wall 102. Further, the opening/closing cover 100C is openable and closable in a vertical direction about unillustrated hinge shafts arranged on a pair of arm portions 108 arranged on opposite lateral end parts (FIG. 2). In an open state of the opening/closing cover 100C, an upper part of the main body internal space 107 is exposed to outside. On the other hand, in a closed state of the opening/closing cover 100C, the upper part of the main body internal space 107 is closed. A developing device 20 and a toner container 30 to be described later are mounted in a developer storage portion 109 of the main body internal space 107.

A sheet discharging portion 102A is arranged in a central part of the upper wall 102. The sheet discharging portion 102A is formed by an inclined surface inclined downwardly from a front part to a rear part of the upper wall 102. A sheet S having an image formed thereon in an image forming unit 120 to be described later is discharged onto the sheet discharging portion 102A. Further, a manual feed tray 104A is arranged in a vertical central part of the main body front wall 104. The manual feed tray 104A is vertically rotatable (arrow DT in FIG. 3) with a lower end thereof as a supporting point.

With reference to FIG. 3, the printer 100 includes a cassette 110, a pickup roller 112, a first feed roller 113, a second feed roller 114, a conveyor roller 115, a pair of registration rollers 116, the image forming unit 120 and a fixing device 130.

The cassette 110 stores sheets S insides. The cassette 110 includes a lift plate 111. The lift plate 111 is so inclined as to push up leading edges of the sheets S. The cassette 110 can be pulled out forward with respect to the housing 101.

The pickup roller 112 is arranged above the leading edges of the sheets S pushed up by the lift plate 111. When the pickup roller 112 rotates, the sheet S is pulled out from the cassette 110.

The first feed roller 113 is arranged downstream of the pickup roller 112 and feeds the sheet S further to a downstream side. The second feed roller 114 is arranged at an inner side (rear side) of the supporting point of the manual feed tray 104A and pulls a sheet S on the manual feed tray 104A into the housing 101.

The conveyor roller 115 is arranged downstream of the first and second feed rollers 113, 114 in a sheet conveying direction (hereinafter, also merely referred to as the conveying direction). The expression "downstream in the conveying direction" may be abbreviated as "downstream" below. The conveyor roller 115 conveys the sheet S fed by the first and second feed rollers 113, 114 further to the downstream side.

The pair of registration rollers 116 have a function of correcting the oblique feed of the sheet S. By this, the position of an image to be formed on the sheet S is adjusted. The pair of registration rollers 116 supply the sheet S to the image forming unit 120 in accordance with an image forming timing by the image forming unit 120.

The image forming unit 120 includes a photoconductive drum 121 (image carrier), a charger 122, an exposure device 123, the developing device 20, the toner container 30 (developer storage container), a transfer roller 126 (transfer unit) and a cleaning device 127.

The photoconductive drum 121 has a cylindrical shape. The photoconductive drum 121 has a surface on which an electrostatic latent image is to be formed, and carries a toner image (developer image) corresponding to the electrostatic latent image on the surface. The charger 122 has a predetermined voltage applied thereto and substantially uniformly charges the peripheral surface of the photoconductive drum 121.

The exposure device 123 irradiates laser light to the peripheral surface of the photoconductive drum 121 charged by the charger 122. The laser light is irradiated in accordance with image data output from an external apparatus (not shown) such as a personal computer communicably connected to the printer 100. As a result, an electrostatic latent image corresponding to the image data is formed on the peripheral surface of the photoconductive drum 121.

The developing device 20 supplies toner to the peripheral surface of the photoconductive drum 121 on which an electrostatic latent image is formed. The toner container 30 supplies the toner to the developing device 20. The toner container 30 is detachably arranged in the developing device 20. When the developing device 20 supplies the toner to the photoconductive drum 121, the electrostatic latent image formed on the peripheral surface of the photoconductive drum 121 is developed (visualized). As a result, a toner image (developer image) is formed on the peripheral surface of the photoconductive drum 121.

The transfer roller 126 is arranged to face the photoconductive drum 121 below the photoconductive drum 121 with the sheet conveyance path PP located therebetween. The transfer roller 126 forms a transfer nip portion N together with the photoconductive drum 121 and causes a toner image to be transferred to the sheet S.

The cleaning device 127 removes the toner remaining on the peripheral surface of the photoconductive drum 121 after the toner image is transferred to the sheet S.

The fixing device 130 is arranged downstream of the image forming unit 120 in the conveying direction and fixes a toner image on a sheet S. The fixing device 130 includes a heating roller 131 for melting the toner on the sheet S and a pressure roller 132 for bringing the sheet S into close contact with the heating roller 131.

The printer 100 further includes a pair of conveyor rollers 133 arranged downstream of the fixing device 130 and a pair of discharge rollers 134 arranged downstream of the pair of conveyor rollers 133. A sheet S is conveyed upwardly by the pair of conveyor rollers 133 and finally discharged from the housing 101 by the pair of discharge rollers 134. Sheets S discharged from the housing 101 are stacked on the sheet discharging portion 102A.

<Concerning Developing Device>

Figure 4:
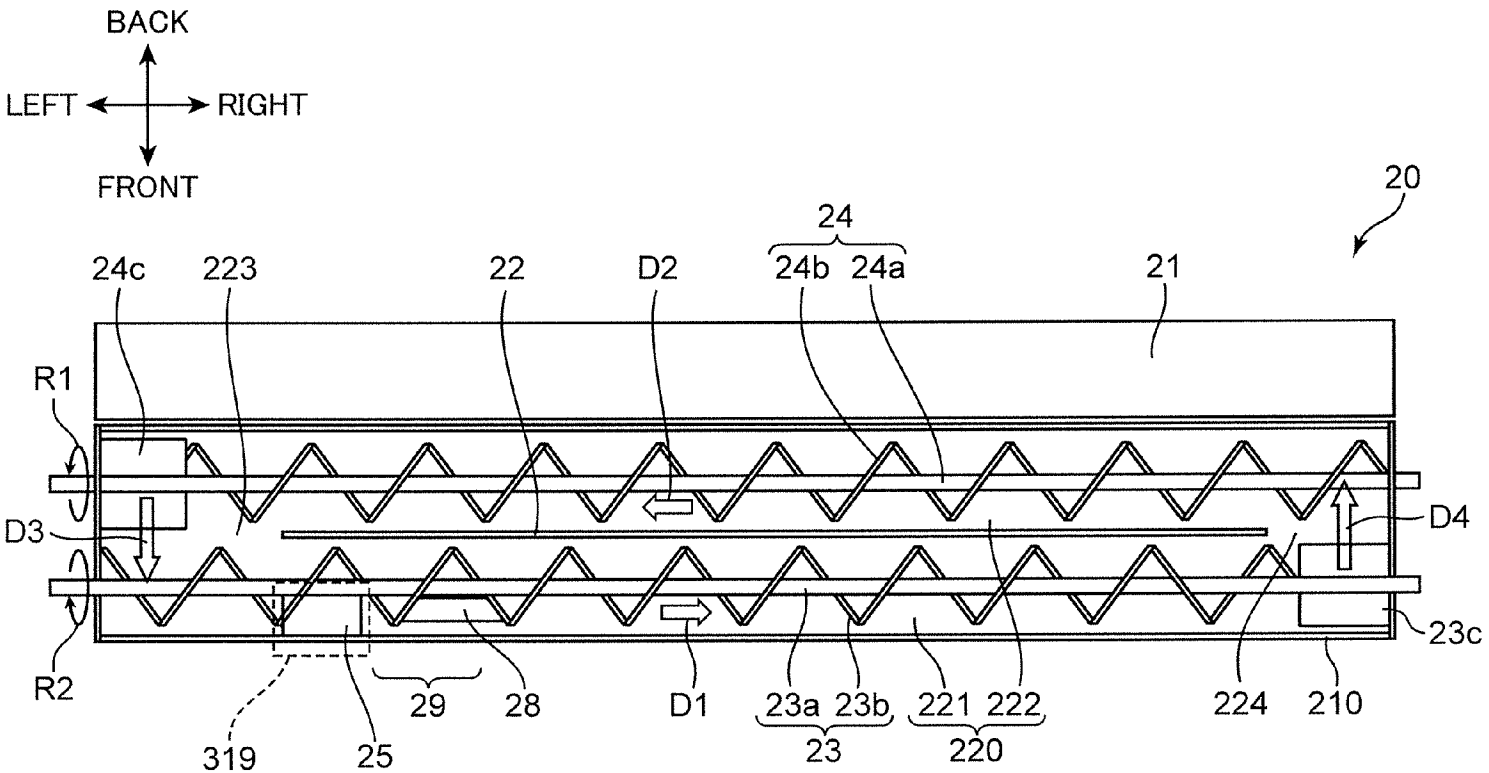
FIG. 4 is a schematic plan view showing the internal structure of a developing device according to the one embodiment of the present disclosure.

FIG. 4 is a plan view showing the internal structure of the developing device 20. The developing device 20 includes a development housing 210 (housing) having a box shape long in one direction (axial direction of a developing roller 21, lateral direction). The development housing 210 has a storage space 220. The developing roller 21, a first stirring screw 23 and a second stirring screw 24, and a toner supply port 25 are arranged in the storage space 220. In this embodiment, a one-component development method is applied and toner is filled as developer in this storage space 220. On the other hand, in the case of a two-component development method, a mixture of toner and carrier made of a magnetic substance is filled as developer. The toner is stirred and conveyed in the storage space 220 and successively supplied from the developing roller 21 to the photoconductive drum 121 to develop an electrostatic latent image.

The developing roller 21 has a cylindrical shape extending in a longitudinal direction of the development housing 210 and includes a sleeve part to be rotationally driven on an outer periphery.

The storage space 220 of the development housing 210 is covered by an unillustrated ceiling plate and partitioned into a first conveyance path 221 and a second conveyance path 222 long in the lateral direction by a partition plate 22 extending in the lateral direction. The partition plate 22 is shorter than a width of the development housing 210 in the lateral direction and a first communication path 223 and a second communication path 224 for allowing communication between the first and second conveyance paths 221, 222 are provided at left and right ends of the partition plate 22. In this way, a circulation path composed of the first conveyance path 221, the second communication path 224, the second conveyance path 222 and the first communication path 223 is formed in the storage space 220. The toner is conveyed counterclockwise in the circulation path in FIG. 4.

The toner supply port 25 is an opening perforated on the ceiling plate and arranged near and above the left end of the first conveyance path 221. The toner supply port 25 is arranged to face the above circulation path and has a function of receiving replenishing toner (replenishing developer) supplied from the toner container 30 into the storage space 220.

The first stirring screw 23 is arranged in the first conveyance path 221. The first stirring screw 23 includes a first rotary shaft 23*a* and a first spiral blade 23*b* (screw blade) spirally projecting on the outer peripheral surface of the first rotary shaft 23*a*. The first stirring screw 23 conveys the toner in a direction of an arrow D1 of FIG. 4 by being rotationally driven about the first rotary shaft 23*a* (arrow R2). The first stirring screw 23 conveys the toner such that the developer passes through a position where the toner supply port 25 is facing the first conveyance path 221. In this way, the first stirring screw 23 has a function of conveying new toner flowing into from the toner supply port 25 and the toner carried into the first conveyance path 221 from the first conveyance path 222 while mixing them. A first paddle 23*c* is arranged downstream of the first stirring screw 23 in a toner conveying direction (direction D1). The first paddle 23*c* is a plate-like member arranged on the first rotary shaft 23*a*. The first paddle 23*c* is rotated together with the first rotary shaft 23*a* and transfers the toner from the first conveyance path 221 to the second conveyance path 222 in a direction of an arrow D4 of FIG. 4.

The second stirring screw 24 is arranged in the second conveyance path 222. The second stirring screw 24 includes a second rotary shaft 24*a* and a second spiral blade 24*b* spirally projecting on the outer peripheral surface of the second rotary shaft 24*a*. The second stirring screw 24 supplies the toner to the developing roller 21 while conveying the toner in a direction of an arrow D2 of FIG. 4 by being rotationally driven about the second rotary shaft 24*a* (arrow R1). A second paddle 24*c* is arranged downstream of the second stirring screw 24 in a toner conveying direction (direction D2). The second paddle 24*c* is rotated together with the second rotary shaft 24*a* and transfers the toner from the second conveyance path 222 to the first conveyance path 221 in a direction of an arrow D3 of FIG. 4.

Figure 6A:
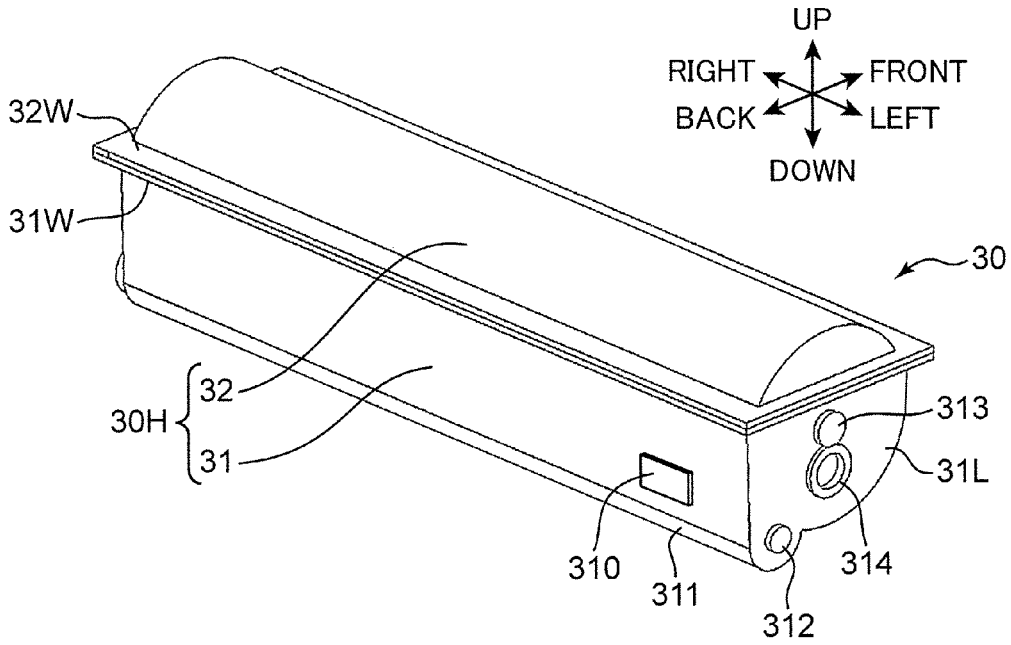
FIGS. 6A and 6B are perspective views of a developer storage container according to the one embodiment of the present disclosure.
Figure 6B:
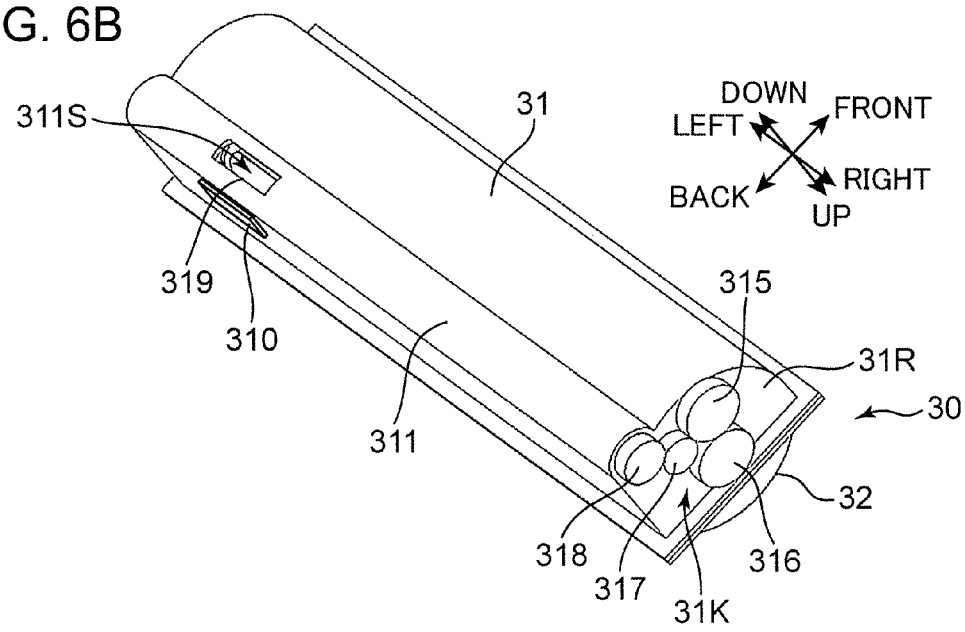

The toner container 30 (FIG. 3) is arranged above the toner supply port 25 of the development housing 210. The toner container 30 includes a toner discharge port 319 (FIGS. 4, 6B). The toner discharge port 319 is arranged to face to the toner supply port 25 of the developing device 20 in the toner container 30 (FIG. 6B). The toner dropped from the toner discharge port 319 is supplied from the toner supply port 25 to the developing device 20.

<Concerning Toner Supply>

Figure 5:
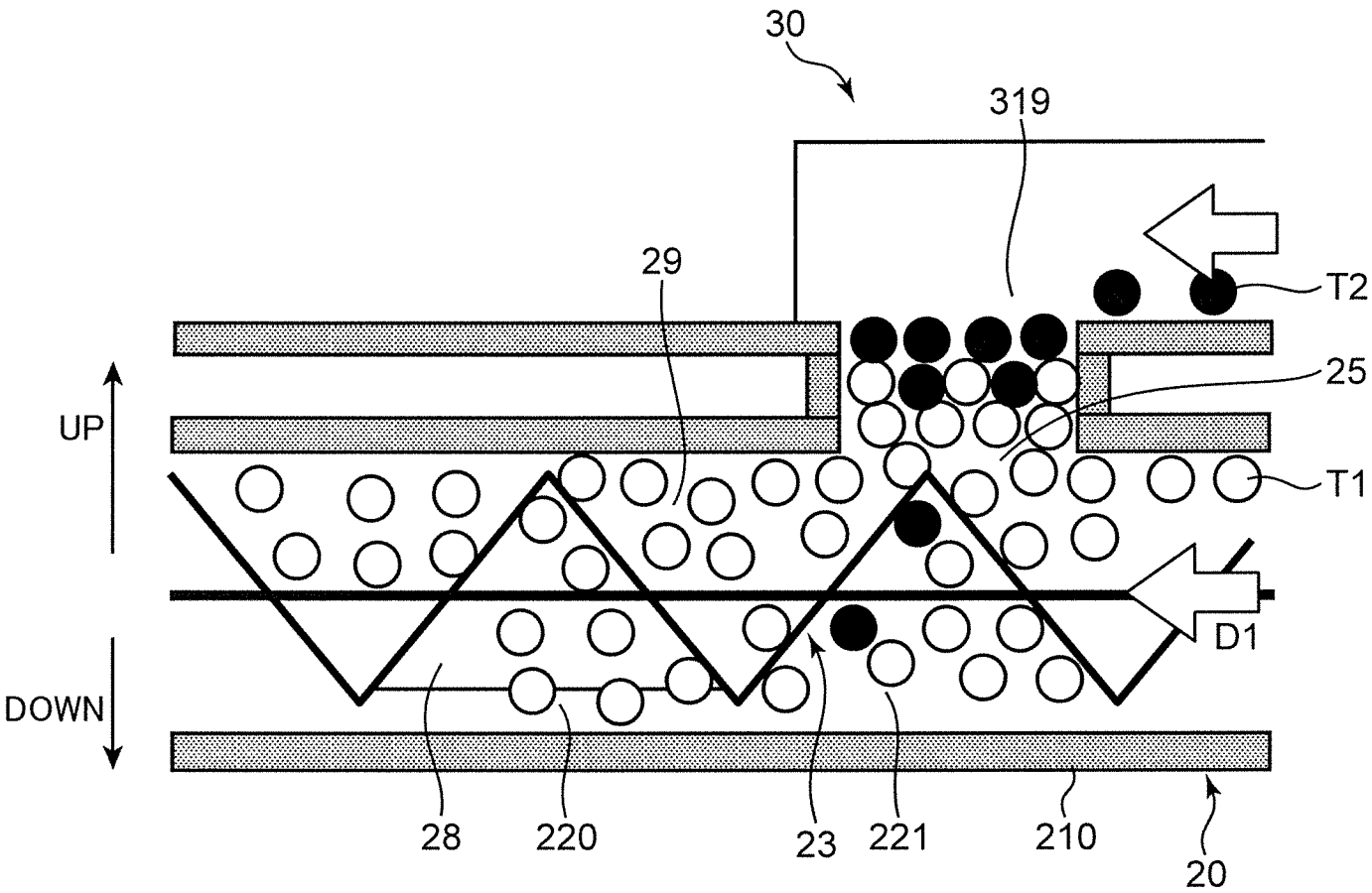
FIG. 5 is a schematic sectional view showing a state where developer is supplied to the developing device according to the one embodiment of the present disclosure.

Next, a flow of the toner newly supplied from the toner supply port 25 is described. FIG. 5 is a sectional view showing the vicinity of the toner supply port 25 arranged on the developing device 20 and the toner discharge port 319 arranged on the toner container 30.

Replenishing toner T2 supplied from the toner discharge port 319 of the toner container 30 drops to the first conveyance path 221 and is mixed with existing toner T1 and conveyed in the direction of the arrow D1 by the first stirring screw 23. At this time, the toner T1 and the toner T2 are stirred to be charged.

The first stirring screw 23 includes a suppression paddle 28 (conveyance performance suppressing portion) with partially reduced conveyance performance for developer on a side downstream of the toner supply port 25 in the toner conveying direction. In this embodiment, the suppression paddle 28 is a plate-like member arranged between adjacent parts of the first spiral blade 23*b* of the first stirring screw 23. By the rotation of the suppression paddle 28 about the first rotary shaft 23*a*, the toner being conveyed from a side upstream of the suppression paddle 28 starts to be retained. The retained toner is accumulated up to a position which is immediately upstream of the suppression paddle 28 and where the toner supply port 25 is facing the first conveyance path 221. As a result, a retaining portion 29 for developer (developer retaining portion) is formed near the entrance of the toner supply port 25.

When the replenishing toner T2 is supplied from the toner supply port 25 and the amount of the toner in the storage space 220 increases, the toner retained in this retaining portion 29 closes (seals) the toner supply port 25, thereby suppressing any further supply of the toner. Thereafter, when the toner in the storage space 220 is consumed by the developing roller 21 and the toner retained in the retaining portion 29 decreases, the toner having closed the toner supply port 25 decreases and a clearance is formed between the retaining portion 29 and the toner supply port 25. As a result, the replenishing toner T2 flows into the storage space 220 from the toner supply port 25 again. As just described, in this embodiment, a volume supply type toner supply method of adjusting the amount of the receiving replenishing toner as the toner retained in the retaining portion 29 decreases is adopted.

<Concerning Structure of Toner Container>

Figure 7A:
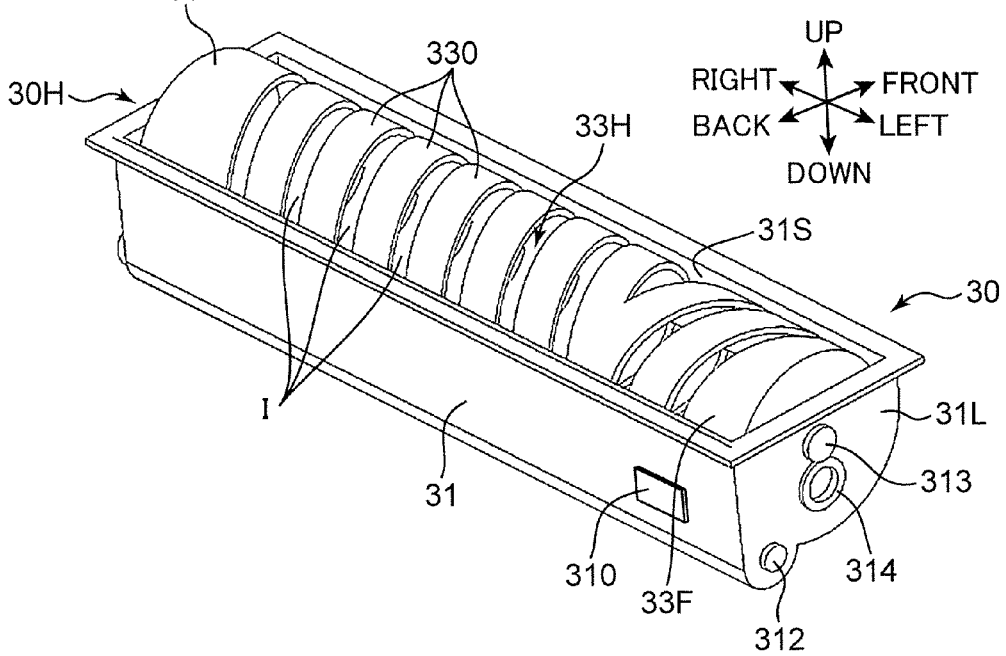
FIGS. 7A and 7B are perspective views showing a state inside the developer storage container according to the one embodiment of the present disclosure.
Figure 7B:
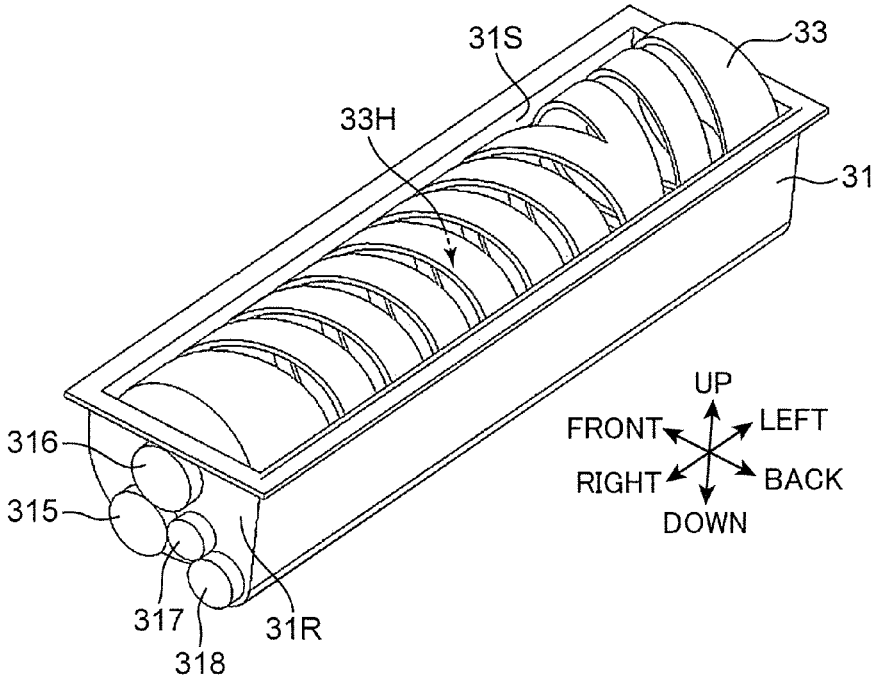
Figure 8A:
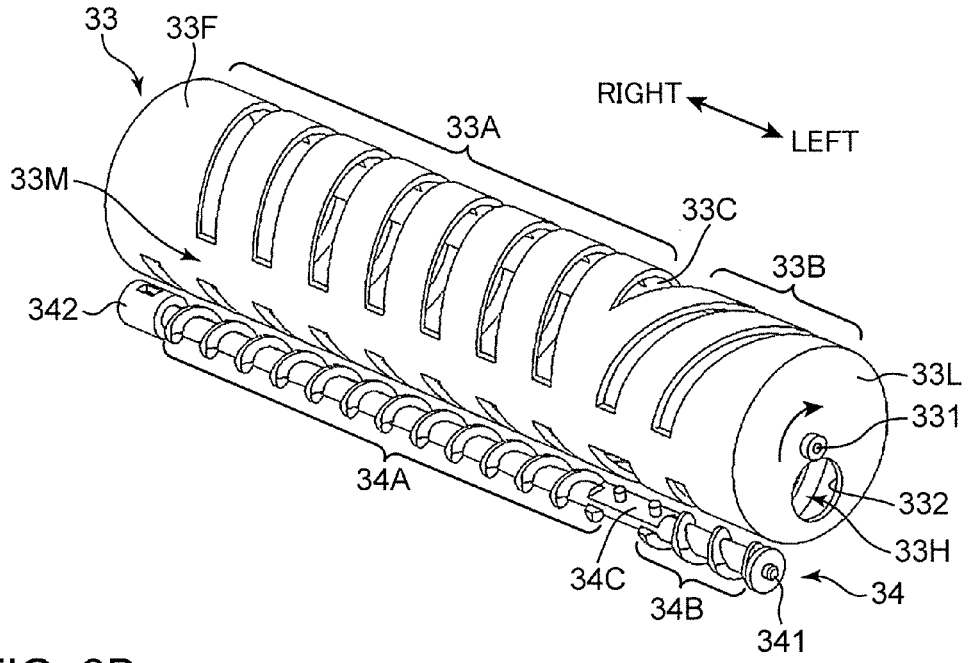
FIGS. 8A and 8B are perspective views of a rotary cylindrical body and a lower conveying member arranged in the developer storage container according to the one embodiment of the present disclosure.
Figure 8B:
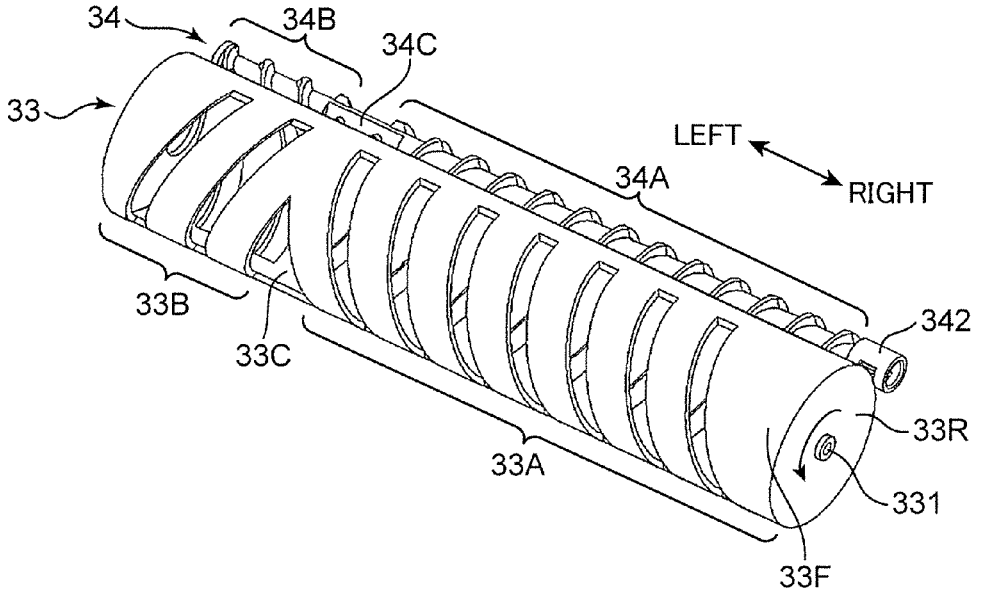
Figure 9:
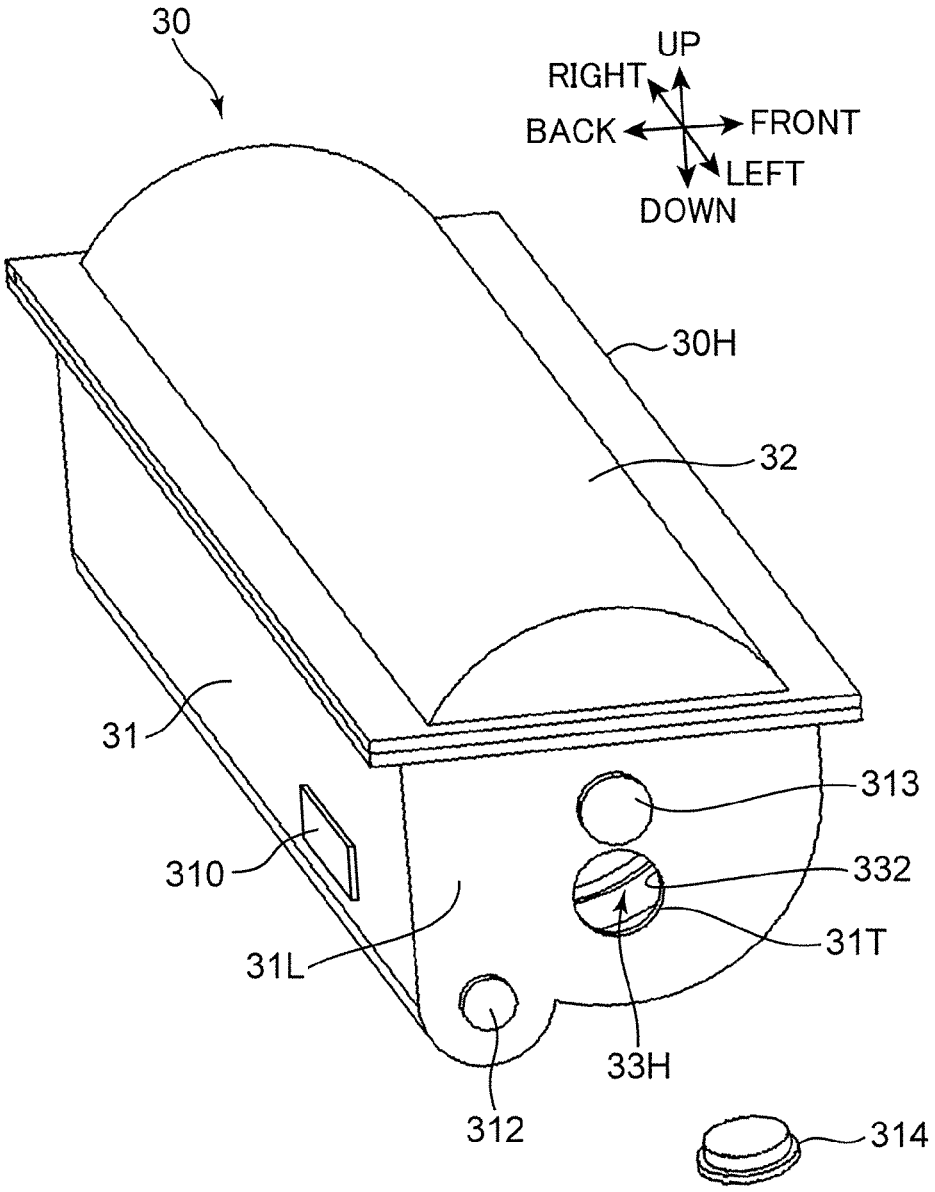
FIG. 9 is a perspective view of the developer storage container according to the one embodiment of the present disclosure.
Figure 10A:
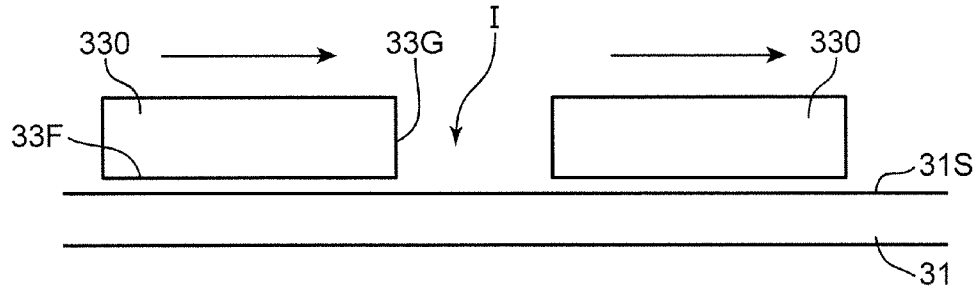
FIGS. 10A, 10B and 10C are schematic sectional views enlargedly showing outer peripheral parts of developer storage containers according to the one embodiment of the present disclosure and modifications.
Figure 10B:
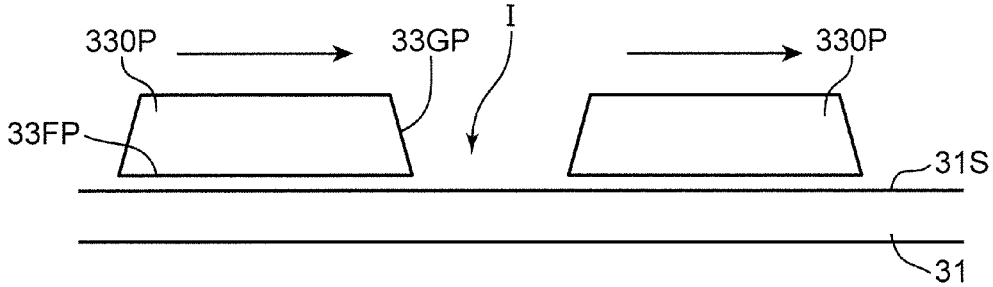
Figure 10C:
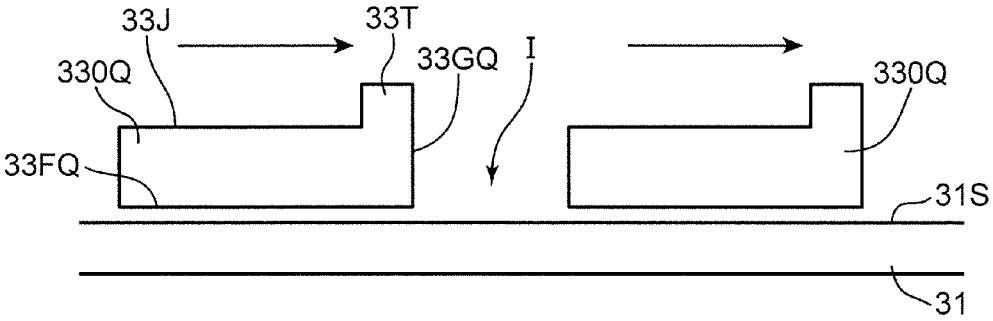

Next, the toner container 30 (developer storage container) according to the embodiment of the present disclosure is described with reference to FIGS. 6A to 10C. FIGS. 6A and 6B are perspective views of the toner container 30 according to the one embodiment of the present disclosure. FIGS. 7A and 7B are perspective views showing a state inside the toner container 30. FIGS. 8A and 8B are perspective views of a cylinder portion 33 and a screw 34 arranged in the toner container 30. FIG. 9 is a perspective view of the toner container 30. FIGS. 10A, 10B and 10C are schematic sectional views enlargedly showing parts (outer peripheral parts) of toner containers according to the one embodiment of the present disclosure and modifications.

With reference to FIGS. 6A to 9, the toner container 30 includes a main body portion 30H, the cylinder portion 33 (rotary cylindrical body) and the screw 34 (lower conveying member). The toner container 30 stores the replenishing toner inside and supplies the replenishing toner to the developing device 20. The toner container 30 is detachably mountable in the housing 101 of the printer 100.

The main body portion 30H is a main body part of the toner container 30. As shown in FIG. 6A, the main body portion 30H has a box shape whose longitudinal direction is the lateral direction. The longitudinal direction is an axial direction in the rotation of the cylinder portion 33 to be described later. The main body portion 30H has a cylindrical inner peripheral surface 31S (see FIGS. 7A, 7B and 10A) and an unillustrated internal space defined by the inner peripheral surface 31S, a main body left wall 31L and a main body right wall 31R. The main body portion 30H includes a container main body 31 and a lid portion 32. The container main body 31 defines a lower part of the main body portion 30H. The lid portion 32 is mounted above the container main body 31 to form the internal space together with the container main body 31. As shown in FIG. 6A, the lid portion 32 has a cylindrical surface to define an upper part of the cylindrical inner peripheral surface 31S. FIGS. 7A and 7B show a state where the lid portion 32 is removed from the toner container 30. Note that the container main body 31 and the lid portion 32 are fixed by placing flange portions 31W, 32W formed into a rectangular shape when viewed from above one over the other and, then, bonding the flange portions.

The container main body 31 includes the main body left wall 31L (main body side end surface), the main body right wall 31R (main body side end surface), a conveying portion 311 (developer conveying portion), a screw bearing portion 312, a cylinder bearing portion 313 (shaft supporting portion), a cap 314 (sealing member), a drive transmission unit 31K (transmission unit) and a main body opening 31T (FIG. 9) (developer filling port). The main body left wall 31L and the main body right wall 31R are left and right side wall portions of the container main body 31 and arranged at opposite ends of the inner peripheral surface 31S. Note that the main body left wall 31L is arranged to face a cylinder left wall 33L of the cylinder portion 33 to be described later and the main body right wall 31R is arranged to face a cylinder right wall 33R of the cylinder portion 33.

The conveying portion 311 extends in the axial direction in the rotation of the cylinder portion 33 on a lower end part of the inner peripheral surface 31S of the container main body 31. The conveying portion 311 has a conveyance space 311S (FIG. 6B) communicating with the internal space of the main body portion 30H. The toner in a storage space 33H to be described later can flow into the conveyance space 311S through slits I (FIG. 7A). Further, the screw 34 to be described later is arranged in the conveyance space 311S. Furthermore, the conveying portion 311 includes the aforementioned toner discharge port 319 (developer discharge port). The toner discharge port 319 is an opening arranged on a left end side of a lower end part of the conveying portion 311. In this embodiment, the toner discharge port 319 is arranged at a position spaced rightwardly from a left end part of the container main body 31 by a predetermined distance. The replenishing toner in the container main body 30 is discharged to the developing device 20 via the toner discharge port 319. Note that an unillustrated shutter is arranged at an outer side of the toner discharge port 319. The shutter is slidable in the lateral direction to open or close the toner discharge port 319.

The screw bearing portion 312 is a bearing portion arranged at a position of the main body left wall 31L corresponding to a left part of the conveying portion 311. The screw bearing portion 312 rotatably supports a screw shaft portion 341 of the screw 34 to be described later.

The cylinder bearing portion 313 is a bearing portion arranged in a central part of the main body left wall 31L and below the flange portion 31W. Note that the cylinder bearing portion 313 is located on an axial center of the cylindrical shape of the main body portion 30H. The cylinder bearing portion 313 rotatably supports a cylinder shaft portion 331 of the cylinder portion 33 to be described later.

The cap 314 is a cap member for sealing the main body opening 31T (FIG. 9) of the container main body 31.

The drive transmission unit 31K is a group of gears provided on the main body right wall 31R. The drive transmission unit 31K is coupled to an unillustrated motor arranged in the housing 101 of the printer 100 and transmits a rotational drive force to the cylinder portion 33 and the screw 34 in synchronization. Specifically, the drive transmission unit 31K includes an input gear 315, a cylindrical gear 316, an idler gear 317 and a screw gear 318. The input gear 315 is arranged on a front and lower part of the main body right wall 31R and coupled to the above motor. The cylindrical gear 316 is coupled to the input gear 315 above the input gear 315. The cylindrical gear 316 is inserted into the internal space of the container main body 31 through the main body right wall 31R and fixed to the cylinder shaft portion 331 of the cylinder portion 33 to be described later. The idler gear 317 is coupled to the input gear 315 behind the input gear 315. The screw gear 318 is a gear coupled to the idler gear 317 and inserted into the conveyance space 311S of the conveying portion 311 through the main body right wall 31R and fixed to a coupling portion 342 of the screw 34 to be described later. As a result, a rotational drive force input to the input gear 315 is transmitted to the cylinder portion 33 and the screw 34 respectively from the cylindrical gear 316 and the screw gear 318. In this embodiment, the cylinder portion 33 and the screw 34 can be rotated by one drive source (motor) by including the drive transmission unit 31K.

The main body opening 31T (FIG. 9) is a circular opening open on the main body left wall 31L. The main body opening 31T is open below the cylinder bearing portion 313, in other words, at a distance from the cylinder bearing portion 313 in a radial direction. The main body opening 31T functions as a filling port for filling the toner into the main body portion 30H. Further, as described above, the main body opening 31*t* is sealed by the cap 314.

The cylinder portion 33 is a member having a cylindrical shape and arranged in the internal space of the main body portion 30H. The cylinder portion 33 has a function of stirring and conveying the toner in the main body portion 30H. The cylinder portion 33 includes a pair of the cylinder left wall 33L and the cylinder right wall 33R (both are rotary body end surfaces), a pair of cylinder shaft portions 331 (rotary shaft), a facing surface (side surface, outer peripheral surface), the storage space 33H, the slits I and a cylinder opening 332 (cylindrical body opening).

The cylinder left wall 33L and the cylinder right wall 33R serve as a pair of end surfaces intersecting with an axial direction of the cylinder portion 33. When the cylinder portion 33 is mounted into the main body portion 30H, the cylinder left wall 33L and the cylinder right wall 33R are respectively arranged to define predetermined clearances at inner sides of the main body left wall 31L and the main body right wall 31R.

The pair of cylinder shaft portions 331 are shaft portions arranged on the cylinder left wall 33L and the cylinder right wall 33R. As described above, the left cylinder shaft portion 331 is rotatably supported on the main body left wall 31L of the container main body 31. On the other hand, the right cylinder shaft portion 331 is coupled to the cylindrical gear 316 provided on the main body right wall 31R. As a result, the cylinder portion 33 is supported in the container main body 31 rotatably about the cylinder shaft portions 331. Note that the cylinder portion 33 is rotated about the cylinder shaft portions 331 in an arrow direction of FIGS. 8A and 8B.

The facing surface 33F is an outer peripheral surface of the cylinder portion 33 having a cylindrical shape. The facing surface 33F is arranged to face the inner peripheral surface 31S of the main body portion 30H with a predetermined clearance defined therebetween (see FIG. 10A). The inner peripheral surface 31S and the facing surface 33F have circular shapes similar to each other in a cross-section perpendicular to the axial direction in the rotation of the cylinder opening 33. The clearance between the inner peripheral surface 31S of the main body portion 30H and the facing surface 33F is set to be a small clearance of 5 mm or smaller. As described above, since the lid portion 32 also has a cylindrical surface for forming the inner peripheral surface 31S, the above clearance is held substantially constant over the entire circumference. The storage space 33H is a hollow space formed radially inwardly of the facing surface 33F. The storage space 33H is defined by the pair of the cylinder left wall 33L and the cylinder right wall 33R and an inner surface of the facing surface 33F. The replenishing toner is stored in the storage space 33H.

The slits I (FIG. 7) are slits formed on the facing surface 33F to allow communication between the storage space 33H and the outside of the cylinder portion 33 (an unillustrated internal space of the main body portion 30H). The slit I is inclined on the facing surface 33F from one axial end side toward the toner discharge port 319 and a plurality of slits I are arranged at intervals in the axial direction. With reference to FIGS. 8A and 8B, the slits I are classified into a cylinder conveying portion 33A (first slit portion), a cylinder reverse-conveying portion 33B (second slit portion) and a cylinder discharging portion 33C in this embodiment. The cylinder discharging portion 33C is arranged at the same position as the toner discharge port 319 in the axial direction.

The aforementioned toner discharge port 319 is arranged to face the facing surface 33F between right and left end parts of the facing surface 33F of the cylinder portion 33. Thus, the cylinder conveying portion 33A and the cylinder reverse-conveying portion 33B convey the toner in opposite directions. The cylinder conveying portion 33A is composed of slits formed with a first inclination from a right end side of the facing surface 33F toward the toner discharge port 319 (toward the cylinder discharging portion 33C). On the other hand, the cylinder reverse-conveying portion 33B is composed of slits formed with a second inclination extending in a direction intersecting with the first inclination from a left end side of the facing surface 33F toward the toner discharge port 319.

The cylinder discharging portion 33C is a triangular slit formed between the cylinder conveying portion 33A and the cylinder reverse-conveying portion 33B. When the cylinder portion 33 is rotated about the cylinder shaft portions 331 as shown by an arrow of FIG. 8B, two oblique sides defining the cylinder discharging portion 33C push the toner in the storage space 33H radially outwardly of the cylinder portion 33. This toner is transferred to a paddle 34C of the screw 34 to be described later and discharged from the toner discharge port 319.

Further, conveying pieces 330 (FIG. 7A) are formed on parts of the facing surface 33F by forming a plurality of slits I on the facing surface 33F as described above. The conveying pieces 330 are adjacently arranged in the axial direction. The conveying pieces 330 correspond to the facing surface 33F between adjacent slits I. The toner in the storage space 33H is conveyed in the conveying direction toward the toner discharge port 319 with the rotation of the slits I, i.e. the rotation of the conveying pieces 330.

Note that, in this embodiment, an opening width of the slits I in the axial direction is set to be smaller than a width of the conveying pieces 330 in the axial direction. Thus, an area where the toner stored in the storage space 30H is in contact with the inner peripheral surface 31S of the main body portion 30H is reduced. Note that, in this embodiment, the aforementioned clearance between the inner peripheral surface 31S of the main body portion 30H and the facing surface 33F of the cylinder portion 33 is set to be smaller than the slit opening width of the cylinder conveying portion 33A and the cylinder reverse-conveying portion 33*b* in the axial direction.

Further, in this embodiment, the plurality of slits I are formed in parallel and the adjacent conveying pieces 330 are connected in the axial direction at a connecting portion 33M (FIG. 8A). In another embodiment, a slit may be spirally arranged by being continuously and obliquely formed on the facing surface 33F.

The cylinder opening 332 is a circular opening open on the cylinder left wall 33L. With reference to FIG. 8A, the cylinder opening 332 is open between the cylinder shaft portion 331 and the outer peripheral edge of the main body left wall 31L.

The screw 34 is arranged in the conveying portion 311 and conveys the toner toward the toner discharge port 319 by being rotationally driven. Further, the screw 34 has a function of discharging the toner from the toner discharge port 319. With reference to FIGS. 8A and 8B, the screw 34 is composed of a shaft portion extending in the lateral direction and a spiral member arranged around the shaft portion. The screw 34 includes a screw conveying portion 34A, a screw reverse-conveying portion 34B, the paddle 34C, the screw shaft portion 341 and the coupling portion 342.

The screw conveying portion 34A is a spiral part arranged to face the cylinder conveying portion 33A of the cylinder portion 33. The screw conveying portion 34A conveys the toner from a right end part of the conveying portion 311 toward the toner discharge port 319. Similarly, the screw reverse-conveying portion 34B is a spiral part arranged to face the cylinder reverse-conveying portion 33B of the cylinder portion 33. The screw reverse-conveying portion 34B conveys the toner from a left end part of the conveying portion 311 toward the toner discharge port 319. The paddle 34C is a plate-like member arranged on the shaft portion to face the cylinder discharging portion 33C and the toner discharge port 319 between the screw conveying portion 34A and the screw reverse-conveying portion 34B. The screw shaft portion 341 is a tip part of the shaft portion arranged on the left end part of the screw reverse-conveying portion 34B and rotatably supported on the screw bearing portion 312 of the container main body 31. The coupling portion 342 is a coupling member arranged on the shaft portion on a right end side of the screw conveying portion 34A and coupled to the screw gear 318 of the container main body 31.

Further, the toner container 30 includes a toner sensor 310 (FIGS. 6A, 6B). The toner sensor 310 is a sensor arranged on a rear side wall of the container main body 31 above the toner discharge port 319. The toner sensor 310 is a magnetic permeability sensor. The toner sensor 310 detects the toner in the storage space 33H and outputs a HIGH signal (+5V). Further, if no toner is present around the toner sensor 310, the toner sensor 310 outputs a LOW signal (0 V). An output signal of the toner sensor 310 is referred to by an unillustrated control unit. Note that since the toner sensor 310 is a magnetic permeability sensor, a sensing surface needs not be directly in contact with the toner unlike a pressure sensor. Thus, even if the outer peripheral surface (facing surface 33F) of the cylinder portion 33 turns around in the vicinity of the inner peripheral surface 31S of the main body portion 30H as in this embodiment, the contact of the toner sensor 310 and the cylinder portion 33 is prevented. Further, by properly setting a detection range of the toner sensor 310 in advance, the toner sensor 310 can detect the presence or absence of the toner stored in the cylinder portion 33. Note that, in another embodiment, the toner sensor 310 may be arranged on the housing 101 of the printer 100 to face an outer wall of the container main body 31. Further, the arrangement of the toner sensor 310 is not limited to that on the rear side wall of the container main body 31. In another embodiment, a toner sensor may be arranged on the lid portion 32 or the conveying portion 311.

With reference to FIGS. 8A and 9, after the cylinder portion 33 and the screw 34 are mounted into the container main body 31 in the manufacturing stage of the toner container 30, the lid portion 32 is fixed to an upper surface part of the container main body 31. Then, with the cap 314 removed from the main body opening 31T, the input gear 315 (FIG. 6B) is rotated by an operator or an unillustrated tool. Eventually, the cylinder opening 332 faces the main body opening 31T at predetermined rotational position of the cylinder portion 33 around the cylinder shaft portions 331 (FIG. 8A), whereby the outside of the main body portion 30H and the storage space 33H communicate. As a result, the toner can be filled into the storage space 33H. Thereafter, the cap 314 is mounted over the main body opening 31T, thereby completing the filling of the toner into the toner container 30.

During the transportation of the toner container 30, the filled toner gradually becomes more solid due to vibration applied to the toner container 30, whereby the density of the toner increases. Further, such as when the toner container 30 is not used for a long time in the printer 100, a phenomenon in which the toner becomes more solid similarly occurs. If a plate-like paddle fixed to a rotary shaft rotates in a toner container as before, a rotational torque abnormally increases and it is difficult to sufficiently stir the toner. Further, since the toner present near the inner wall of the toner container is difficult to flow, there has been a problem that an excessive load is applied to the paddle and the paddle is broken.

On the other hand, according to the toner container 30 of this embodiment, the cylinder portion 33 rotates via the input gear 315 when the unillustrated control unit rotationally drives the unillustrated motor according to an output of the toner sensor 310 (FIG. 6A). At this time, the toner is easily rotationally moved since being stored in the storage space 33H inside the cylinder portion 33. Particularly, since the facing surface 33F of the cylinder portion 33 is arranged to face the inner peripheral surface 31S of the cylinder main body 31 with the tiny clearance defined therebetween as shown in FIG. 10A, a large amount of the toner is not solidified and adheres to the inner peripheral surface 31S. Accordingly, when the rotation of the cylinder portion 33 is started, a force for scraping the toner near the inner peripheral surface 31S off the inner peripheral surface 31S is almost unnecessary and an increase of the rotational torque of the cylinder portion 33 is suppressed. Further, a tiny amount of the toner present near the slits I is moved in the conveying direction shown by arrows of FIG. 10A by conveying surfaces 33G of the conveying pieces 330. As a result, the stirring and conveyance of the toner are stably realized and the breakage of the cylinder portion 33 associated with a torque increase is prevented. The toner in the storage space 33H is stably conveyed toward a side above the toner discharge port 319 by conveying forces of the cylinder conveying portion 33A and the cylinder reverse-conveying portion 33B (FIG. 8A). As a result, in many cases, a user needs not to shake the toner container 30 in using the toner container 30.

The toner conveyed to an area where the cylinder conveying portion 33A and the cylinder reverse-conveying portion 33B are adjacent is discharged from the toner discharge port 319 by a rotational force of the paddle 34C after being transferred to the paddle 34C by a rotational force of the cylinder discharging portion 33C. Further, the toner having dropped to the conveying portion 311 from the slits I of the cylinder conveying portion 33A and the cylinder reverse-conveying portion 33B is similarly discharged from the toner discharge port 319 after being conveyed to the toner discharge port 319 by the screw 34. Since the conveyance space 311S (FIG. 6B) of the conveying portion 311 is easily filled with the toner along the axial direction particularly in this embodiment, a flow rate of the toner discharged from the toner discharge port 319 can be kept at a predetermined value. Thus, the toner can be stably supplied to the developing device 20 from the toner discharge port 319. Further, since the storage space 33H of the cylinder portion 33 is set to be large as compared with the conveyance space 311S of the conveying portion 311, the toner idly rotates in the storage space 33H when the conveyance space 311S is fully filled with the toner. Thus, the toner is prevented from excessively flowing into the conveyance space 311S and aggregating in the conveying portion 311.

Further, in this embodiment, the opening width of the slits I is set to be smaller than the width of the conveying pieces 330 when the facing surface 33F is viewed in the axial direction as described above. Thus, the area where the toner stored in the storage space 33H is in contact with the inner peripheral surface 31S of the main body portion 30H is reduced and the rotational torque of the cylinder portion 33 is further reduced.

Furthermore, the left and right side surfaces of the cylinder portion 33 are closed by the cylinder left wall 33L and the cylinder right wall 33R except at the cylinder opening 332. Thus, an area where the toner is in contact with the main body portion 30H can be reduced and the rotational torque of the cylinder portion 33 can be further reduced as compared with the case where all the side surfaces of the cylinder portion 33 are opened.

Further, the cylinder opening 332 is opened on one circumferential part of the cylinder left wall 33L (FIG. 8A). Thus, even if the cap 314 is erroneously removed during the use of the toner container 30, the wall surface of the cylinder left wall 33L is arranged to face an inner side of the main body opening 31T in many cases. This prevents a large amount of the toner from leaking out from the main body portion 31T.

Further, according to this embodiment, even if the toner discharge port 319 is arranged between one axial end side and the other axial end side, the toner stored in the storage space 33H can be stably conveyed toward the toner discharge port 319 by the inclination of the cylinder conveying portion 33A and the cylinder reverse-conveying portion 33B.

The toner container 30 and the printer 100 provided with the toner container 30 according to the embodiment of the present disclosure have been described above. According to the present disclosure, even if the toner container 30 is left unused for a long time and the toner inside becomes more solid, the toner in the storage space 33H is easily rotationally moved with the rotation of the cylinder portion 33. Further, the toner is supplied to the developing device 20 while the stirring and conveyance of the toner are stably realized in the toner container 30, and an image forming operation on a sheet S is stably realized. Note that the present disclosure is not limited to this. For example, the following modifications can be adopted.

(1) Although the conveying surfaces 33G of the conveying pieces 330 formed by the thickness of the cylinder portion 33 in a radial direction are arranged to be perpendicular to the facing surface 33F as shown in FIG. 10A in the above embodiment, the present disclosure is not limited to this. As shown in FIG. 10B, wall surfaces (conveying surfaces 33GP) of a cylinder portion defining upstream end parts of slits I in the conveying direction may be inclined to the upstream side in the conveying direction from a facing surface 33FP toward a radially inner side. In this case, the toner present near the slits I is moved to the radially inner side by the conveying surfaces 33GP when the rotation of the cylinder portion 33 is started. Thus, an increase of the rotational torque when the rotation of the cylinder portion 33 is started can be further suppressed. Further, as shown in FIG. 10C, wall surfaces (conveying surfaces 33GQ) of a cylinder portion defining upstream end parts of slits I in the conveying direction may project further radially inwardly than inner peripheral portions 33J (cylindrical body inner peripheral portions) of conveying pieces 330Q. Specifically, projections 33T projecting radially inwardly are provided on tip end sides of the conveying pieces 330Q in the conveying direction. In this case, a force for conveying the toner in the conveying direction toward the toner discharge port 319 can be increased.

(2) Further, although the toner container 30 includes the conveying portion 311 and the screw 34 in the above embodiment, the present disclosure is not limited to this. The toner container 30 may be composed only of the main body portion 30H and the cylinder portion 33. In this case, the toner discharge port 319 is opened on the bottom surface of the cylinder main body 31 and the toner is discharged from the toner discharge port 319 by the rotational force of the cylinder portion 33.

(3) Although the toner discharge port 319 is opened at a position to the right of the left end part of the conveying portion 311 in the above embodiment, the present disclosure is not limited to this. The toner discharge port 319 may be opened on one axial end part of the container main body 31. In this case, the cylinder portion 33 or the screw 34 may include the slits I for conveying the toner in one direction. Further, the shape of the slits I is not limited to the above one. A plurality of openings may be adjacently arranged in the circumferential or axial direction.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

What is claimed is:

1. A developer storage container, comprising:

a main body portion with a cylindrical inner peripheral surface and a pair of main body side end surfaces arranged at opposite ends of the inner peripheral surface, an internal space of the main body portion being defined by the inner peripheral surface and the pair of main body side end surfaces;

a rotary cylindrical body with a side surface having a cylindrical shape, a pair of rotary body end surfaces arranged at opposite ends of the side surface, a pair of rotary shafts arranged on the rotary body end surfaces and a storage space defined by an inner surface of the side surface and the pair of rotary body end surfaces and configured to store developer;

wherein:

a slit extending in a circumferential direction is formed on the side surface of the rotary cylindrical body to allow communication between the internal space and the storage space, the rotary cylindrical body is so arranged in the internal space that a predetermined clearance is defined between the side surface and the inner peripheral surface of the main body portion, and rotatably supported on the pair of main body side end surfaces with the rotary shafts, a developer discharge port which communicates with the internal space and from which the developer is discharged is opened on the main body portion, the slit is inclined on the side surface from one end side of the rotary shaft in an axial direction toward the developer discharge port and a plurality of slits are arranged at intervals in the axial direction, the developer in the storage space is conveyed in a conveying direction toward the developer discharge port with the rotation of the slits about the rotary shaft, and an opening width of the slits in the axial direction is set to be smaller than a width of the side surface between adjacent slits in the axial direction.

2. A developer storage container according to claim 1, wherein:

the slit is spirally formed on the side surface to be inclined from one end side of the rotary shaft in an axial direction toward the developer discharge port, and the developer in the storage space is conveyed in a conveying direction toward the developer discharge port with the rotation of the slit about the rotary shaft.

3. A developer storage container according to claim 1, wherein:

the developer discharge port is arranged to face the rotary cylindrical body between one end part and the other end of the rotary cylindrical body in the axial direction, and the slits include:

a first slit portion formed with a first inclination from one end side of the side surface toward the developer discharge port; and a second slit portion formed with a second inclination extending in a direction intersecting with the first inclination from the other end side of the side surface toward the developer discharge port.

4. A developer storage container according to claim 1, wherein, the rotary cylindrical body includes a cylindrical body opening which is open on one of the pair of end surfaces at a distance from the rotary shaft in a radial direction, one of the pair of main body side end surfaces has:

a shaft supporting portion configured to rotatably support the rotary shaft;

a developer filling port opened on the main body side end surface at a distance from the shaft supporting portion in a radial direction; and a sealing member configured to seal the developer filling port, and the outside of the main body portion and the storage space are allowed to communicate and it is enabled to fill the developer into the storage space by causing the cylindrical body opening to face the developer filling port at predetermined rotational position of the rotary cylindrical body about the rotary shaft.

5. A developer storage container according to claim 1, wherein:

the main body portion includes a developer conveying portion, the developer conveying portion has a conveyance space, which extends in the axial direction to communicate with the internal space and into which the developer in the storage space is flowable via the slit, in a lower end part of the inner peripheral surface, the developer discharge port being formed on a lower end part of the developer conveying portion, and a lower conveying member arranged in the developer conveying portion and configured to be rotationally driven and convey the developer toward the developer discharge port.

6. A developer storage container according to claim 5, further comprising:

a transmission unit arranged on the main body portion and configured to transmit a rotational drive force to the rotary cylindrical body and the lower conveying member in synchronization.

7. An image forming apparatus, comprising:

a developer storage container according to claim 1;

an image carrier on a surface of which an electrostatic latent image is to be formed and which carries a developer image;

a developing device to which the developer is supplied from the developer storage container and which supplies the developer to the image carrier; and a transfer unit which transfers the developer image from the image carrier to a sheet.

8. A developer storage container, comprising:

a main body portion with a cylindrical inner peripheral surface and a pair of main body side end surfaces arranged at opposite ends of the inner peripheral surface, an internal space of the main body portion being defined by the inner peripheral surface and the pair of main body side end surfaces;

a rotary cylindrical body with a side surface having a cylindrical shape, a pair of rotary body end surfaces arranged at opposite ends of the side surface, a pair of rotary shafts arranged on the rotary body end surfaces and a storage space defined by an inner surface of the side surface and the pair of rotary body end surfaces and configured to store developer;

wherein:

a slit extending in a circumferential direction is formed on the side surface of the rotary cylindrical body to allow communication between the internal space and the storage space, the rotary cylindrical body is so arranged in the internal space that a predetermined clearance is defined between the side surface and the inner peripheral surface of the main body portion, and rotatably supported on the pair of main body side end surfaces with the rotary shafts, a developer discharge port which communicates with the internal space and from which the developer is discharged is opened on the main body portion, the slit is inclined on the side surface from one end side of the rotary shaft in an axial direction toward the developer discharge port and a plurality of slits are arranged at intervals in the axial direction, the developer in the storage space is conveyed in a conveying direction toward the developer discharge port with the rotation of the slits about the rotary shaft, the side surface of the rotary cylindrical body has a predetermined thickness, and wall surfaces of the rotary cylindrical body defining upstream end parts of the slits in the conveying direction are inclined to an upstream side in the conveying direction toward a radially inner side of the rotation.

9. A developer storage container, comprising:

a main body portion with a cylindrical inner peripheral surface and a pair of main body side end surfaces arranged at opposite ends of the inner peripheral surface, an internal space of the main body portion being defined by the inner peripheral surface and the pair of main body side end surfaces;

a rotary cylindrical body with a side surface having a cylindrical shape, a pair of rotary body end surfaces arranged at opposite ends of the side surface, a pair of rotary shafts arranged on the rotary body end surfaces and a storage space defined by an inner surface of the side surface and the pair of rotary body end surfaces and configured to store developer;

wherein:

a slit extending in a circumferential direction is formed on the side surface of the rotary cylindrical body to allow communication between the internal space and the storage space, the rotary cylindrical body is so arranged in the internal space that a predetermined clearance is defined between the side surface and the inner peripheral surface of the main body portion, and rotatably supported on the pair of main body side end surfaces with the rotary shafts, a developer discharge port which communicates with the internal space and from which the developer is discharged is opened on the main body portion, the slit is inclined on the side surface from one end side of the rotary shaft in an axial direction toward the developer discharge port and a plurality of slits are arranged at intervals in the axial direction, the developer in the storage space is conveyed in a conveying direction toward the developer discharge port with the rotation of the slits about the rotary shaft, the side surface of the rotary cylindrical body has a predetermined thickness, and wall surfaces of the rotary cylindrical body defining upstream end parts of the slits in the conveying direction project from the inner surface of the side surface toward a radially inner side of the rotation.

* * * * *